United States Patent [19]

Milani et al.

[11] Patent Number: 4,788,965

[45] Date of Patent: Dec. 6, 1988

[54] INCUBATOR

[75] Inventors: Francesco Milani, Giubiasco, Switzerland; Wolfgang Franz; Michael Geier, both of Lübeck, Fed. Rep. of Germany; Jochim Koch, Hollenbek, Fed. Rep. of Germany

[73] Assignee: Drägerwerk Aktiengesellschaft, Lübeck, Fed. Rep. of Germany

[21] Appl. No.: 22,260

[22] Filed: Mar. 5, 1987

[30] Foreign Application Priority Data

Mar. 19, 1986 [DE] Fed. Rep. of Germany ..... 3609147

[51] Int. Cl.[4] ..... A61G 11/00

[52] U.S. Cl. ..... 600/22

[58] Field of Search ..... 128/1 B, 1 R; 292/DIG. 17

[56] References Cited

U.S. PATENT DOCUMENTS

| | | | |
|---|---|---|---|
| 390,569 | 10/1888 | Coffey | 292/DIG. 17 |
| 1,639,009 | 8/1927 | Singley | 292/DIG. 17 |
| 3,161,923 | 12/1964 | Crain | 292/228 |
| 3,335,713 | 8/1967 | Grosholz et al. | 128/1 B |
| 3,818,896 | 6/1974 | Deaton | 128/1 B |

*Primary Examiner*—Edward M. Coven
*Assistant Examiner*—J. P. Lacyk
*Attorney, Agent, or Firm*—Walter Ottesen

[57] ABSTRACT

An incubator has a transparent covering hood having at least one side wall on which two flaps are mounted for closing access openings formed in the side wall. The flaps are each provided with a hinge and closure element. The flaps and access openings are so configured that the maximum possible freedom of movement is provided for the person treating the patient while at the same time the smallest possible outlet area is attained to prevent heat and oxygen losses from within the incubator to the ambient. For this purpose, the access openings are configured to be elongated and so that their respective longitudinal axes conjointly define an upwardly facing obtuse angle. To improve visibility for observing the premature infant and to improve ergonomically correct actuation of the operating elements, both the hinge and the closure element are located together on one side of the flap.

5 Claims, 2 Drawing Sheets

INCUBATOR

FIELD OF THE INVENTION

The invention relates to an incubator for premature infants in which at least one side wall surface of a transparent covering hood is provided with two flaps for closing access openings. The flaps have hinges and closing latches.

BACKGROUND OF THE INVENTION

U.S. Pat. No. 3,335,713 discloses an incubator wherein a resting surface is located on a lower part, and the interior of the incubator is sealed off by a transparent covering hood. The atmosphere of the interior, which is fixed in terms of certain prerequisites such as temperature, oxygen content, and humidity, remains closed off from the ambient. For performing treatment and nursing procedures, access openings are disposed in pairs, but because of the requirement for maintaining the interior atmosphere, these openings should expose only a relatively small acess area in the opened state. The requirement for a small access area of the access openings is in opposition to the need of having sufficient freedom of movement for the hands and arms of the person treating the patient, and for good accessibility to all the important areas of the interior.

SUMMARY OF THE INVENTION

An object of the invention is to provide an incubator having access openings which provide a large working area in the interior, while at the same time the area of the opening remains relatively small. According to a feature of the invention, the access openings are configured to be elongated and the longitudinal axes conjointly define an obtuse angle opening upwardly. This contour of the access openings provides a favorably large working region in the interior of the incubator, as compared with the known circular or elliptical access openings, while having the same pass-through area.

The access openings can suitably have a rounded triangular form having substantially horizontally disposed base edges. As a result, treatment and nursing procedures can be performed satisfactorily even if the upper body of the premature is raised or if the legs of the patient are raised, with a correspondingly tilted resting surface.

Since the covering hood and the flaps are of transparent material, it also appears suitable to place the hinge and the closure element for locking each flap in the closed position on the same side of the flap. As a result, there is minimum hindrance to visibility. Furthermore, the elements to be used by a person standing in front of the incubator for opening the flaps are located with ergonomical correctness directly before the right or left arm, hand or elbow, depending on how the flap is to be opened, which is freely up to the person operating it. According to another feature of the invention, the hinges and the lock elements are located on the peripheral region of the flaps, remote from the point of intersection of the longitudinal axes. As a result, the central viewing area for viewing the patient lying in the incubator is not blocked by closure elements.

To keep the flaps firmly held in a position that does not hinder access when opened, the axes of rotation of the flaps are disposed such that they are inclined in the upward direction away from the side wall face and toward their outer edges. With this disposition of the axes of rotation, an automatic opening pivoting movement of the flaps takes place under gravity when the closure elements are unlocked. This provision also provides a stable opening position of the flaps, with an opening angle of approximately 135°, and the flaps are prevented from striking the side wall. An edge seal at the periphery of the access openings can suitably be configured such that a rubber-elastic annular ridge disposed here reinforces the operation of opening the flaps.

BRIEF DESCRIPTION OF THE DRAWINGS

The invention will now be described with reference to the drawing wherein.

DESCRIPTION OF THE PREFERRED EMBODIMENTS OF THE INVENTION

Figure 1:
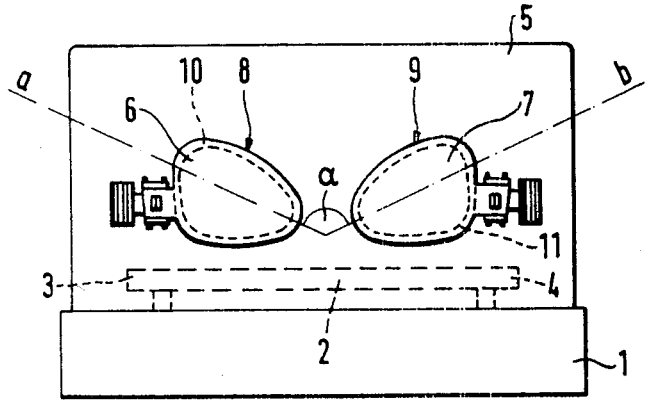
FIG. 1 is a front elevation view of an embodiment of an incubator according to the invention.

In FIG. 1, a lower portion 1 is seen, on which a bed 2 for receiving premature infants thereon is secured. A head portion 3 and a foot portion 4 of the bed 2 are adjustable in elevation and are tiltable.

The bed 2 is covered with a transparent covering hood 5, which has two flaps (6, 7) which cover respective access openings (8, 9). In the peripheral region of the access openings (8, 9), respective rubber-elastic annular ridge-like seals (10, 11) are provided.

Figure 2:
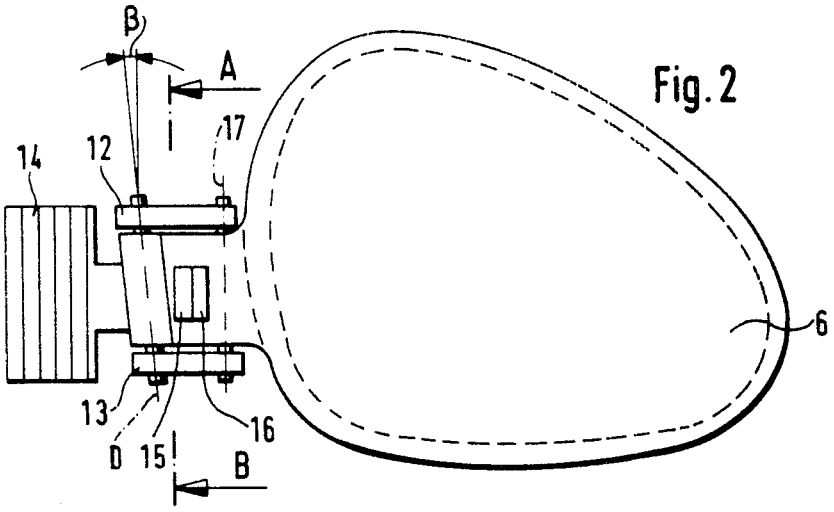
FIG. 2 is a detail showing a flap of the incubator of FIG. 1 complete with hinge and latch.
Figure 3:
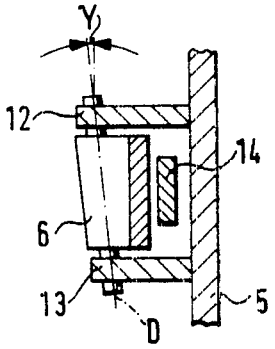
FIG. 3 is a section taken along the line A-B of FIG. 2.

The access openings (8, 9) are configured in the form of rounded triangles and have respective longitudinal axes (a, b) which conjointly define an obtuse ($\alpha$) of approximately 120°. Each of the flaps (6, 7) covering the respective access openings (8, 9) are pivotally mounted at hinge brackets (12, 13) as shown in FIG. 2 for flap 6. The axis of rotation D of the hinge comprising the hinge brackets 12, 13 is inclined in the upward direction away from the side wall surface of the covering hood toward the front (angle $\gamma$ of 5°, for example) and also is inclined toward the outer lateral edge of the side wall surface at an angle ($\beta$) of 5°, for example. The result is an automatic opening pivoting movement of the flap after the latter is unlatched and a detent-like positioning of the flap in the open position.

Figure 4:
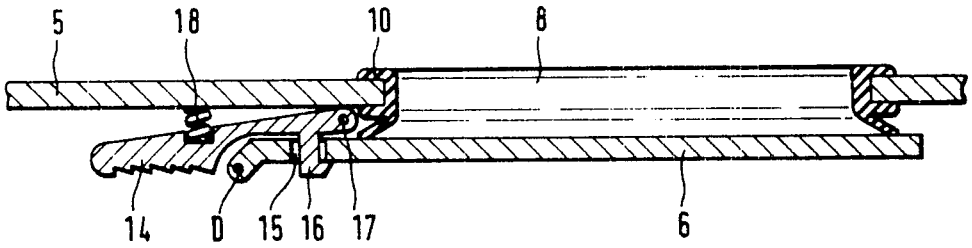
FIG. 4 is a section taken through the latch of one of the flaps of the incubator of FIG. 1.

In addition to the hinge brackets (12, 13), a closure element or latch is provided for securing the flap in its closed position. The latch is shown in further detail in FIG. 4 and comprises a tilt lever 14 mounted on the side wall of the hood 5 so as to be journalled for pivoting about a vertical pivot axis 17. The tile lever 14 engages the flap 6 from behind through an opening 15. When the flap 6 is closed, the hook 16 of the tilt lever 14 engages the outer face of the flap 6 from behind. The hook 16 is disposed between the pivot axis D of the flap 6 and the pivot axis 17 of the tilt lever 14. In this way, if there is an attempt to open the flap 6 from the inside of the incubator, the locking action is still further reinforced. For releasing the latch, the tilt lever 14 is pressed against the force of a spring 18.

A hinge and a latch of the same kind are provided for flap 7 as well.

It is understood that the foregoing description is that of the preferred embodiments of the invention and that various changes and modifications may be made thereto without departing from the spirit and scope of the invention as defined in the appended claims.

What is claimed is:

1. An incubator comprising:

a base;

a transparent hood mounted on said base and having a side wall;

said side wall defining a horizontal axis extending parallel to said base and said side wall having two access openings forming therein;

each of said access openings having a longitudinal axis defining an acute angle with said horizontal axis and being elongated along said axis thereof, said openings being unsymmetrical with respect to the longitudinal axis corresponding thereto and being disposed in said side wall so as to cause said axes to intersect at a point to conjointly define an obtuse angle opening upwardly;

two flaps corresponding to respective ones of said access openings;

hinge means for pivotally mounting each of said flaps to said side wall so as to enable the flap to pivot between a first position whereat the flap covers and closes off the access opening and a second position whereat the flap is away from said opening; and, latching means for latching each of said flaps in the first position.

2. An incubator comprising:

a horizontally extending base;

a transparent hood mounted on said base and having a side wall;

said side wall having two access openings formed therein, each of said access openings having a longitudinal axis and being elongated along said axis thereof, said openings being disposed in said side wall so as to cause said axes to intersect at a point to conjointly define an obtuse angle opening upwardly;

each of said elongated access openings being a triangular opening having a base and rounded corners, and each of said access openings being positioned in said side wall so that said base of said triangular opening lies substantially parallel to said base of said incubator;

two flaps corresponding to respective ones of said access openings;

hinge means for pivotally mounting each of said flaps to said side wall so as to enable the flap to pivot between a first position whereat the flap covers and closes off the access opening and a second position whereat the flap is away from said opening; and, latching means for latching each of said flaps in the first position.

3. The incubator of claim 2, said hinge means and said latching means being mounted on the same side of the flap; said flaps having respective side edges remote from the point of intersection of said axes; and said hinge means and said latch means being mounted at said side edges thereby providing a clear view to the inside of the incubator in the region between said flaps.

4. The incubator of claim 3, said hinge means of each flap including bracket means defining a pivot axis disposed with respect to said side wall so as to cause the flap to pivot outwardly to said second position under the force of gravity when said latching means is released.

5. The incubator of claim 4, said side wall having vertical lateral side edges and said brackets defining said pivot axis so as to be inclined away from said side wall and toward the closest one of said side edges in the upwardly extending direction.

* * * * *

UNITED STATES PATENT AND TRADEMARK OFFICE

CERTIFICATE OF CORRECTION

PATENT NO. : 4,788,965

DATED : December 6, 1988

INVENTOR(S) : Francesco Milani, Wolfgang Franz, Michael Geier and Jochim Koch

It is certified that error appears in the above-identified patent and that said Letters Patent is hereby corrected as shown below:.

In column 2, line 37: between "obtuse" and "(α)", insert -- angle --.

In column 2, line 55: delete "tile" and substitute -- tilt -- therefor.

In column 3, line 11: delete "forming" and substitute -- formed -- therefor.

Signed and Sealed this

Twenty-second Day of August, 1989

*Attest:*

*Attesting Officer*

DONALD J. QUIGG

*Commissioner of Patents and Trademarks*